US008579662B2

(12) United States Patent
Briant et al.

(10) Patent No.: US 8,579,662 B2
(45) Date of Patent: Nov. 12, 2013

(54) ELECTRICAL CONNECTOR ASSEMBLY HAVING HIGH SPEED SIGNAL PAIRS

(75) Inventors: Eric David Briant, Dillsburg, PA (US); Craig William Clewell, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 59 days.

(21) Appl. No.: 13/289,088

(22) Filed: Nov. 4, 2011

(65) Prior Publication Data

US 2013/0115814 A1 May 9, 2013

(51) Int. Cl.
*H01R 13/648* (2006.01)

(52) U.S. Cl.
USPC ..... 439/607.08

(58) Field of Classification Search
USPC ..... 439/607.08, 374, 682, 108, 79, 74, 660
See application file for complete search history.

(56) References Cited

U.S. PATENT DOCUMENTS

| | | | | |
|---|---|---|---|---|
| 6,663,402 | B1 * | 12/2003 | Yu | 439/108 |
| 6,942,524 | B2 | 9/2005 | Wu | |
| 7,210,955 | B2 | 5/2007 | Ringler et al. | |
| 7,710,734 | B2 | 5/2010 | Ice et al. | |
| 7,833,068 | B2 | 11/2010 | Bright et al. | |
| 7,859,849 | B2 | 12/2010 | Ice | |
| 7,892,013 | B1 | 2/2011 | Piekos et al. | |
| 7,896,661 | B2 * | 3/2011 | Yao et al. | 439/83 |
| 8,328,565 | B2 * | 12/2012 | Westman et al. | 439/108 |
| 8,398,425 | B2 * | 3/2013 | Suzuki et al. | 439/374 |
| 2012/0021654 | A1 * | 1/2012 | Westman et al. | 439/682 |

* cited by examiner

*Primary Examiner* — Jean F Duverne

(57) ABSTRACT

An electrical connector includes a connector housing and first and second differential contacts. A contact cavity is defined between opposed sides and opposed endwalls. First support members and second support members extend from the opposed sides into the contact cavity. Each of first support members is shorter than each of the second support members. The first and second differential contacts define a differential pair retained within the contact cavity. The first and second differential contacts are retained between two of the first support members. At least a portion of the first and second differential contacts extends past a level of the first support members. The portion(s) of the first and second differential contacts that extends past the level of first support members is exposed to air.

19 Claims, 11 Drawing Sheets

ELECTRICAL CONNECTOR ASSEMBLY HAVING HIGH SPEED SIGNAL PAIRS

BACKGROUND

The subject matter herein relates generally to electrical connector assemblies that include high speed signal pairs.

Various communication or computing systems use electrical connectors for transmitting data signals between different components of the systems. For example, some electrical connectors may be configured to receive an edge of an electrical component having component contacts located along the edge. The electrical connectors may include housing cavities having opposing rows of mating contacts. When the edge of the electrical component is advanced into the housing cavity of the electrical connector, the edge moves between the opposing rows of mating contacts. The component contacts electrically engage the mating contacts in the housing cavity.

Typically, an electrical connector includes a main housing that retains a plurality of electrical contacts. The main housing generally includes support ribs that extend along a length of each contact. However, it has been found that the ribs interfere with and limit the data rate potential of the electrical contacts.

SUMMARY

Certain embodiments provide an electrical connector configured to electrically connect a first electrical component to a second electrical component. The electrical connector may include a connector housing and first and second differential contacts that define a differential pair that may be positioned between two straddling ground contacts. The connector may include a plurality of first and second differential contacts defining a plurality of differential pairs that may be bounded by two straddling ground contacts.

The connector housing may have opposed sides connected to opposed endwalls. A contact cavity is defined between the opposed sides and the opposed endwalls. A plurality of first support members and a plurality of second support members extend from the opposed sides into the contact cavity. Each of the plurality of first support members may be shorter than each of the plurality of second support members.

The first and second differential contacts define a differential pair retained within the contact cavity. The first and second differential contacts may be retained within the contact cavity between two of the plurality of first support members. At least a portion of each of the first and second differential contacts extends past a level of the plurality of first support members. The portion of each of the first and second differential contacts that extends past the level of the first support members is exposed to air.

The electrical connector may also include a first ground contact adjacent to a first side of the differential pair, and a second ground contact adjacent to a second side of the differential pair, wherein the second side is opposite the first side. Each of the first and second ground contacts may be retained within the contact cavity between one of the plurality of second support members and one of the plurality of first support members. Each of the plurality of second support members is at least as long as the first and second ground contacts.

The electrical connector may also include a plurality of non-high speed high contacts, such as power contacts retained within the contact cavity between two of the plurality of second support members. The second support members are at least as long as the plurality of power contacts.

The portions of the first and second differential contacts that extend past the level of the first support members may not be bound by any portion of the plurality of first support members.

Each of the first and second differential contacts may include a contact tail integrally connected to a moveable beam that is, in turn, integrally connected to a mating tip. In at least one embodiment, the at least a portion of the first and second differential contacts that extends past the level of the first support members includes the mating tip. In at least one embodiment, the at least a portion of the first and second differential contacts that extends past the level of the first support members includes the contact tail. The differential pair may be retained within an air pocket of the connector housing.

Each of the plurality of first support members may include a first support wall. Each of the plurality of second support members may include an extension rib extending from a second support wall.

The connector housing may include a component-receiving region configured to receive a plug connector. Optionally, the connector housing may include a plug portion configured to be received and retained by a receptacle connector.

Certain embodiments provide an electrical connector configured to electrically connect a first electrical component to a second electrical component. The electrical connector may include a connector housing, first differential contacts, second differential contacts, first ground contacts, second ground contacts, and power contacts.

The connector housing may include opposed sides connected to opposed endwalls. A contact cavity is defined between the opposed sides and the opposed endwalls, wherein first support members and second support members extend from the opposed sides into the contact cavity. Each of the first support members may include a first support wall. Each of the second support members may include an extension member extending from a second support wall. Each of the second support members may be longer than each of the first support members.

The first differential contacts and second differential contacts define differential pairs retained within the contact cavity. Each of the first and second differential contacts may be retained within the contact cavity between two of the first support members. At least a portion of each of the first and second differential contacts is exposed to air by extending past a level of the first support members.

Each of the differential pairs may be positioned within the contact cavity between one of the first ground contacts and one of the second ground contacts. Each of the first and second ground contacts may be retained within the contact cavity between one of the second support members and one of the first support members. Each of the second support members may be at least as long as each of the first ground contacts and the second ground contacts.

DETAILED DESCRIPTION

Figure 1:
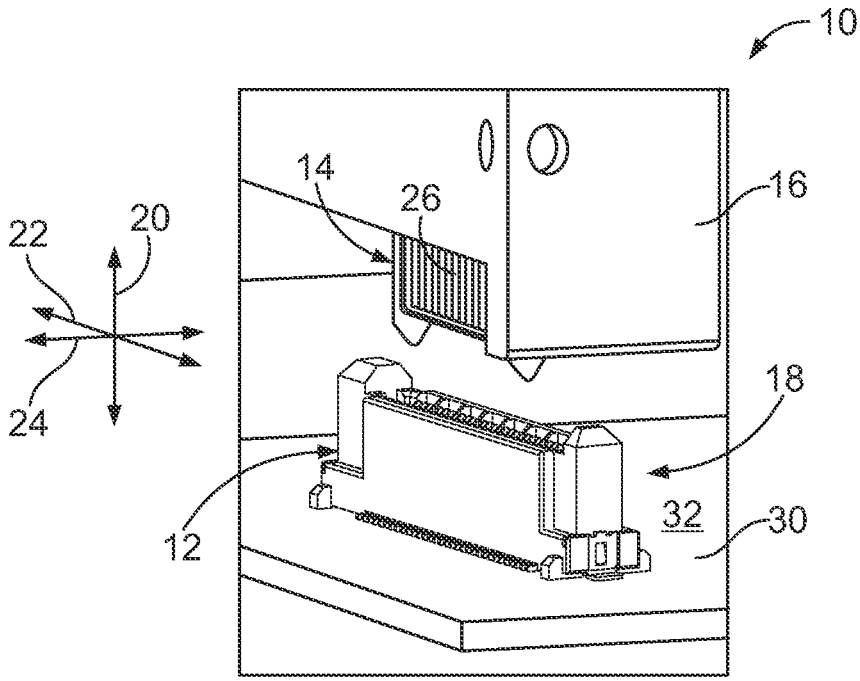
FIG. 1 illustrates a perspective view of a communication system according to an embodiment.

FIG. 1 illustrates a perspective view of a computer or communication system 10 according to an embodiment. The system 10 includes an electrical connector, such as a receptacle connector 12 and a mating electrical connector, such as a plug connector 14.

Figure 2:
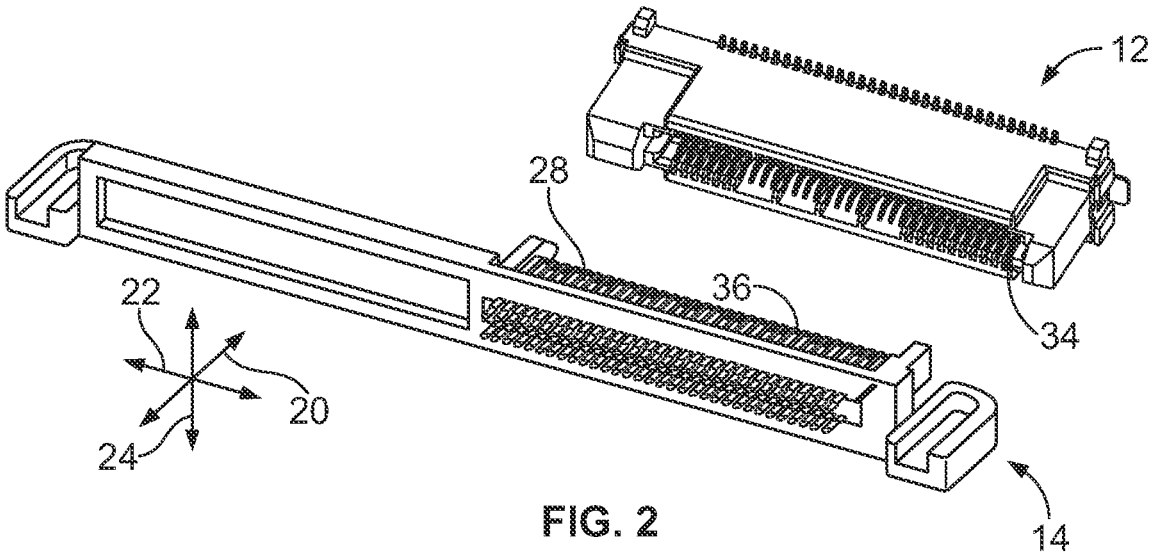
FIG. 2 illustrates a perspective view of a receptacle connector and plug connector according to an embodiment.

FIG. 2 illustrates a perspective view of the receptacle connector 12 and the plug connector 14. Referring to FIGS. 1 and 2, the system 10 may include an electrical component 16 (FIG. 1) that includes the plug connector 14 and a receptacle assembly 18 (FIG. 1) that includes the receptacle connector 12 and is configured to communicatively engage the electrical component 16. As shown, the system 10 and the electrical and mating connectors 12 and 14 are oriented with respect to mutually perpendicular axes 20, 22, and 24, including a mating axis 20, a longitudinal axis 22, and an orientation axis 24. The electrical component 16 includes a first row of component contacts 26 (FIG. 1) and a second row of component contacts 28 (FIG. 2). The first and second rows of component contacts 26 and 28 may be arranged parallel to each other along the longitudinal axis 22. The first row and the second row of component contacts 26 and 28 may face in opposite directions along the orientation axis 24.

As shown in FIG. 1, the receptacle assembly 18 may include a circuit board 30 that has a board surface 32 having a plurality of electrical contacts (not shown). The electrical contacts may be, for example, contact pads or plated through-holes. The receptacle connector 12 is configured to be mounted to the board surface 32. As shown in FIG. 2, the receptacle connector 12 has a component-receiving region 34 that is configured to receive the electrical component 16. More specifically, the component-receiving region 34 is configured to receive a mating tip or edge 36 of the plug connector 14 that has the component contacts 26 and 28 located along the edge 36. During a mating operation, the first and second rows of component contacts 26 and 28 are advanced in a mating direction along the mating axis 20 into the component-receiving region 34. The component contacts 26 and 28 are configured to electrically engage corresponding mating contacts (shown in FIG. 3) of the receptacle connector 12 thereby communicatively coupling the circuit board 30 and the electrical component 16.

The electrical component 16 may be, for example, a solid state drive and the receptacle connector 12 may be configured to communicatively couple to the solid state drive. However, in alternative embodiments, the receptacle connector 12 may be an edge-to-edge or straddle-mount connector that receives and holds a circuit board. In the illustrated embodiment, the receptacle connector 12 is a vertical connector because the component-receiving region 34 of the receptacle connector 12 opens away from the board surface 32. However, in alternative embodiments, the receptacle connector 12 may be a right-angle connector in which the component-receiving region 34 opens in a direction that is parallel to the plane of the board surface 32. The receptacle connector 12 may have other geometries as well.

In some embodiments, the receptacle connector 12 may be configured to transmit high-speed data signals, such as data signals greater than about 10 gigabits/second (Gbs) or data signals greater than about 15 Gbs. In particular embodiments, the receptacle connector 12 may be configured to transmit data signals at speeds above 20 Gbs and up to about 24 Gbs or more.

Figure 3:
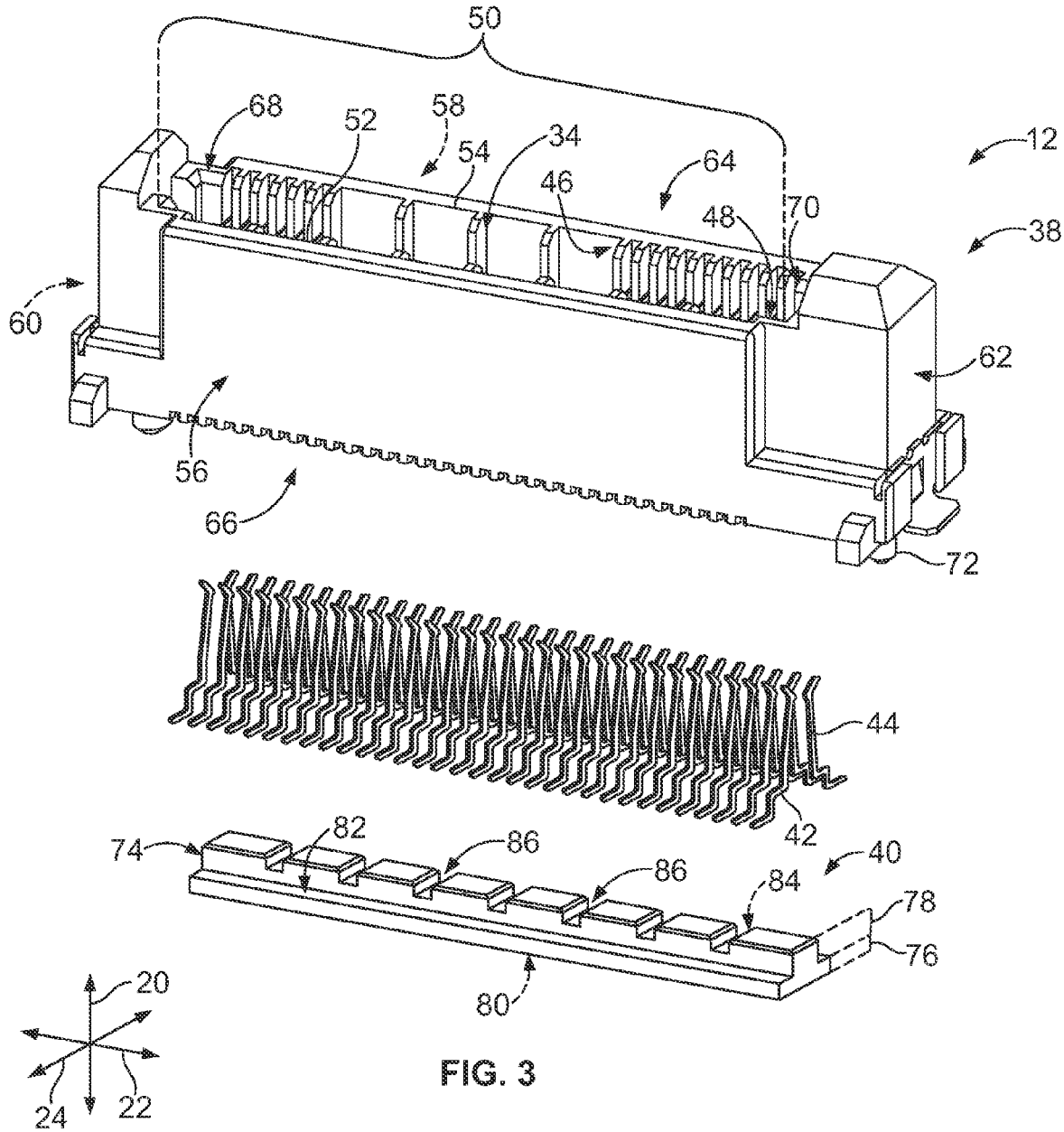
FIG. 3 illustrates an exploded view of a receptacle connector, according to an embodiment.

FIG. 3 illustrates an exploded view of the receptacle connector 12, according to an embodiment. As shown, the receptacle connector 12 may include a connector housing 38, a retention insert 40, and a plurality of mating contacts 42 and 44, which include differential contacts 42*a* and 44*a*, ground contacts 42*b* and 44*b*, and power contacts 42*c*, as shown and described with respect to FIGS. 5-8. Two adjacent differential contacts 42*a* form a differential pair, while two adjacent differential contacts 44*a* form another differential pair. The connector housing 38 may have interior walls 46 and 48 that oppose each other with a contact cavity 50 therebetween. The mating contacts 42 and 44 and the retention insert 40 are positioned within the contact cavity 50 when the receptacle connector 12 is fully assembled. The contact cavity 50 includes the component-receiving region 34. The mating contacts 42 may be arranged in a first row, and the mating contacts 44 may be arranged in a second row that opposes the first row. When the receptacle connector 12 is fully assembled, the first and second rows of mating contacts 42 and 44 are held between the connector housing 38 and the retention insert 40 within the contact cavity 50. For example, the first row of mating contacts 42 may be located within contact channels 52 of the interior wall 48 and held between the retention insert 40 and the interior wall 48. The second row of mating contacts 44 may be located within contact channels 54 of the interior wall 46 and held between the retention insert 40 and the interior wall 46. As explained below with respect to FIGS. 6-8, the contact channels 52 and 54 that retain differential pairs are truncated or otherwise shorter than contact channels that retain power, low speed signal, or ground contacts, for example. When the receptacle connector 12 is assembled, the component-receiving region 34 exists between the first and second rows of mating contacts 42 and 44.

In the illustrated embodiment, the connector housing 38 is capable of independently holding the mating contacts 42 and 44 before the retention insert 40 is positioned within the contact cavity 50. However, in alternative embodiments, the retention insert 40 may be capable of independently holding the mating contacts 42 and 44 before the retention insert 40 is positioned within the connector housing 38. In another alternative embodiment, neither the connector housing 38 nor the retention insert 40 is capable of independently holding the mating contacts 42 and 44.

The connector housing 38 may have opposite housing sides 56 and 58 that extend along a plane that includes the mating axis 20 and the longitudinal axis 22. The housing sides 56 and 58 may face in generally opposite directions along the orientation axis 24. The connector housing 38 may also have opposite endwalls 60 and 62 that extend along a plane that includes the mating axis 20 and the orientation axis 24. The endwalls 60 and 62 may face in generally opposite directions along the longitudinal axis 22. In the illustrated embodiment, the connector housing 38 is substantially block-shaped. However, the connector housing 38 may have other geometries in alternative embodiments.

Also shown, the connector housing 38 may have opposite mating and loading faces 64 and 66. The mating axis 20 extends between the mating and loading faces 64 and 66, and the mating and loading faces 64 and 66 face in generally opposite directions along the mating axis 20. The loading face 66 is configured to be mounted to an electrical component, such as the circuit board 30 (FIG. 1). The loading face 66 may be mounted to the board surface 32 (FIG. 1). In alternative embodiments, such as when the receptacle connector 12 is a right-angle connector, the mating and loading faces 64 and 66 may not face in generally opposite directions, but may face in directions that are substantially perpendicular to each other.

The connector housing 38 may include one or more alignment features, such as cavities, recesses, edges, posts, and the like that facilitate aligning the connector housing 38 with either or both of the electrical components (e.g., the electrical component 16 or the circuit board 30). Such alignment features may be configured to engage corresponding alignment features of the other electrical component. For example, the connector housing 38 may define one or more spatial regions 68 and 70 that are proximate to the component-receiving region 34. In the illustrated embodiment, the contact cavity 50 includes the component-receiving region 34 and the spatial regions 68 and 70 such that the component-receiving region 34 and the spatial regions 68 and 70 are portions of a common space. However, in alternative embodiments, the component-receiving region 34 may be separated from the spatial regions 68 and 70. The spatial regions 68 and 70 are sized and shaped to receive a corresponding alignment feature of the electrical component 16.

Also shown in FIG. 3, the loading face 66 may include one or more posts 72 that are configured to be inserted into holes (not shown) of the circuit board 30 to properly align the receptacle connector 12. In alternative embodiments, the connector housing 38 may include posts or other projections that extend away from the mating face 64 to be received by corresponding spatial regions of the electrical component 16. Furthermore, in alternative embodiments, the loading face 66 may include spatial regions that are sized and shaped to receive posts that are attached to the circuit board 30.

The contact cavity 50 may be accessible through the mating face 64 and also through the loading face 66. For example, the mating contacts 42 and 44 and the retention insert 40 may be configured to be inserted into the contact cavity 50 through the loading face 66. In the illustrated embodiment, the contact cavity 50 may be completely or entirely surrounded by the connector housing 38 and opens in opposite directions along the mating axis 20. For example, the housing sides 56 and 58 and the endwalls 60 and 62 completely surround the contact cavity 50. However, in alternative embodiments, the connector housing 38 may only surround a portion of the contact cavity 50. For instance, the connector housing 38 may only comprise the housing sides 56 and 58 and the endwall 60. A gap may exist where the endwall 62 is located in the illustrated embodiment. Instead, the retention insert 40 may be sized and shaped to fill in the gap.

The retention insert 40 is sized and shaped to be advanced through the loading face 66 and positioned within the contact cavity 50. The retention insert 40 extends lengthwise along the longitudinal axis 22 when positioned within the connector housing 38. As shown, the retention insert 40 includes an outer engagement surface 74. In the illustrated embodiment, the engagement surface 74 directly engages the mating contacts 42 and 44 and interfaces with the connector housing 38.

As shown, the retention insert 40 may include a platform portion 76 and a cavity portion 78. The engagement surface 74 may extend along both of the platform and cavity portions 76 and 78. The platform portion 76 may have an insert side 80 that faces in an opposite direction with respect to the engagement surface 74. The insert side 80 may form a portion of the loading face 66 when the retention insert 40 is positioned within the contact cavity 50. The platform portion 76 may include shoulder sections 82 and 84 that are separated by the cavity portion 78. The shoulder sections 82 and 84 may face in a direction along the mating axis 20 toward the mating face 64. At least a portion of the shoulder sections 82 and 84 may extend along a plane that is substantially perpendicular to the mating axis 20. As such, the retention insert 40 may be substantially T-shaped. Also shown, the cavity portion 78 may extend along the platform portion 76 and include a plurality of recesses 86.

Figure 4:
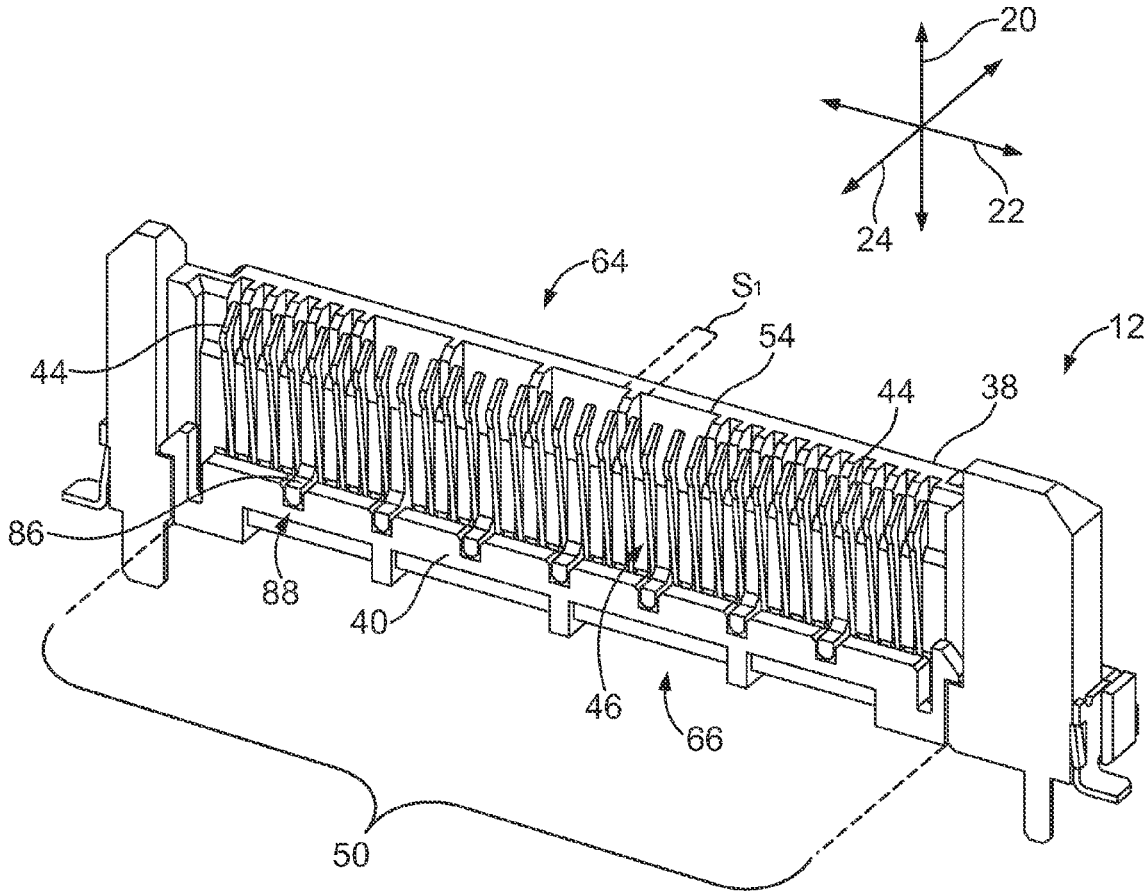
FIG. 4 illustrates a cross-section of a receptacle connector, according to an embodiment.

FIG. 4 illustrates a cross-section of the receptacle connector 12. Although FIG. 4 only illustrates one half of the exemplary contact cavity 50, the opposite half may include similar features. As shown, the interior wall 46 may be shaped to define a plurality of the contact channels 54. The contact channels 54 may be distributed along a length of the interior wall 46 parallel to the longitudinal axis 22. The contact channels 54 extend parallel to the mating axis 20. Adjacent contact channels 54 may be separated from each other by a centerline spacing $S_1$. As explained below with respect to FIGS. 6-8, the contacts channels for differential contacts are shorter than the contact channels for ground contacts, low speed contacts, and power contacts. Also shown, the connector housing 38 may include bridge supports 88 that extend parallel to the orientation axis 24 between the interior wall 48 (FIG. 3) and the interior wall 46. The bridge supports 88 mechanically join the interior walls 46 and 48 and are configured to prevent the interior walls 46 and 48 from separating when the retention insert 40 is moved between the first and second rows of mating contacts 42 (FIG. 3) and 44. As shown, the bridge supports 88 are spaced apart from each other along the length of the interior wall 46.

When the receptacle connector 12 is assembled, the mating contacts 44 are inserted into corresponding contact channels 54. The mating contacts 44 form the first row when located within the contact channels 54. In the illustrated embodiment, the mating contacts 44 are inserted through the loading face 66, but may be inserted through the mating face 64 in other embodiments. The mating contacts 44 may be held by the connector housing 38 within the contact channels 54. For example, the connector housing 38 may form an interference fit with each of the mating contacts 44. In the exemplary embodiment, after the mating contacts 44 are located within the corresponding contact channels 54, the retention insert 40 may be advanced through the loading face 66 along the mating axis 20. The recesses 86 are configured to receive the bridge supports 88 when the retention insert 40 is advanced therein. The bridge supports 88 and the retention insert 40 may form a substantially flush surface.

Figure 5:
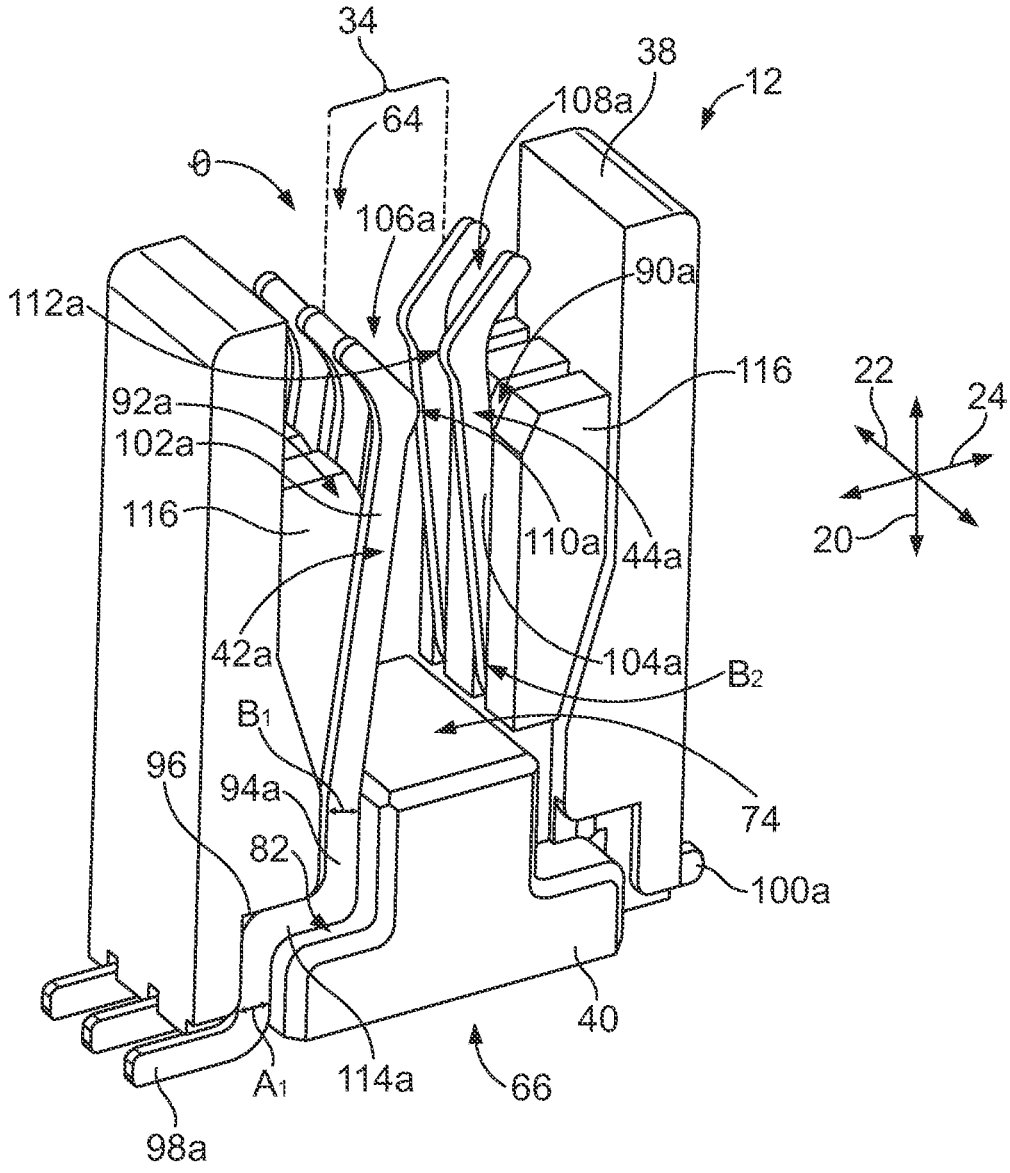
FIG. 5 illustrates an enlarged cross-section of a receptacle connector, according to an embodiment.

FIG. 5 illustrates an enlarged cross-section of the receptacle connector 12. In particular, FIG. 5 illustrates a portion of the receptacle connector 12 that retains differential contacts 42*a* and 44*a*. The enlarged cross-section in FIG. 5 illustrates the connector housing 38 and the first and second rows of the differential contacts 42*a* and 44*a*. The differential contacts 44*s* and 42*a* are located in corresponding contact channels 90*a* and 92*a*, respectively. When the retention insert 40 is advanced into the contact cavity 50 through the loading face 66, the retention insert 40 may engage the differential contacts 44*a* and 42*a*. The differential contacts 44*a* and 42*a* may be pressed against the interior walls 46 and 48 (FIG. 3) of the connector housing 38 by the engagement surface 74 of the retention insert 40. In some embodiments, the mating contacts 44 and 42 collectively hold the retention insert 40 in the contact cavity 50, and the retention insert 40 does not contact any portion of the connector housing 38. The retention insert 40 and the connector housing 38 may hold the differential contacts 44*a* and 42*a* therebetween along corresponding interference sections 94*a* of the differential contacts 44*a* and 42*a*. (Only the interference section 94*a* is shown with respect to the differential contact 42*a*, but the mating contact 44*a* may also include an interference section 94*a*.)

The engagement surface 74 may generally face toward the mating face 64 in a direction that is parallel to the mating axis 20. The engagement surface 74 and the differential contacts 42*a* and 44*a* may have complementary contours such that a corresponding path of the differential contacts 42*a* and 44*a* extends generally alongside the engagement surface 74. In such embodiments, the engagement surface 74 may be shaped to resist movement of the differential contacts 42*a* and 44*a* in the mating direction when the electrical component 16 (FIG. 1) engages the differential contacts 42*a* and 44*a*.

As shown in FIG. 5, the interference section 94*a* of the differential contact 42 extends from point $A_1$ to point $B_1$ along the mating contact 42. The interference section 94*a* includes one or more portions of the differential contact 42*a* that directly engage the connector housing 38 and the retention insert 40. For example, the shoulder section 82 of the engagement surface 74 may directly engage the differential contact 42*a*. The connector housing 38 may have a housing-contact surface 96 that directly engages the differential contact 42*a*. The housing contact surface 96 and the shoulder section 82 may directly oppose each other with the differential contact 42*a* pressed therebetween. In addition to the above example, the connector housing 38 and/or the retention insert 40 may directly engage the differential contact 42*a* at other portions along the interference section 94*a*.

The differential contacts 42*a* and 44*a* may also include contact tails 98*a* and 100*a*, respectively. The contact tails 98*a* and 100*a* are configured to be coupled to corresponding electrical contacts (not shown) of the circuit board 30 (FIG. 1). For example, the contact tails 98*a* and 100*a* may be soldered to contact pads or inserted into plated thru-holes. In addition, the differential contacts 42*a* and 44*a* may include movable beams 102*a* and 104*a*, respectively. The movable beam 102*a* may extend from about the point $B_1$ to a distal end 106*a* of the differential contact 42*a*. The movable beam 104*a* may extend from about a point $B_2$ to a distal end 108*a* of the differential contact 44*a*. The differential contacts 42*a* and 44*a* may have mating tips 110*a* and 112*a*, respectively, that are proximate to the distal ends 106*a* and 108*a*, respectively. The movable beams 102*a* and 104*a* represent portions of the differential contacts 42*a* and 44*a* that move when the differential contacts 42*a* and 44*a* engage the electrical component 16. For example, when the edge 36 (FIG. 2) of the plug connector 14 (FIG. 1) advances into the contact cavity 50, the movable beams 102*a* and 104*a* may deflect away from each other in respective directions along the orientation axis 24. The mating tips 110*a* and 112*a* may slide along corresponding surfaces of the electrical component 16 and engage corresponding component contacts. Biasing forces from the deflected differential contacts 42*a* and 44*a* may press the mating tips 110*a* and 112*a* against the corresponding component contacts to maintain an electrical connection throughout operation of the receptacle connector 12.

In the illustrated embodiment, the differential contacts 42*a* and 44*a* may be stamped from a conductive sheet of material. In particular embodiments, a thickness of the differential contacts 42*a* and 44*a* may be less than about 0.2 mm, and a width (measured from one stamped edge to the other) of the differential contacts 42*a* and 44*a* may be less than about 0.5 mm. In some embodiments, the differential contacts 42*a* and 44*a* may have a substantially uniform cross-section along the respective interference sections 94*a*. The differential contacts 42*a* and 44*a* may also have substantially uniform cross-sections along the respective movable beams 102*a* and 104*a* until the mating tips 110*a* and 112*a*, respectively.

As shown in FIG. 5, a corresponding path of the differential contact 42*a* along the interference section 94*a* may be nonlinear and, more specifically, have a contoured shape with one or more curves. For example, the interference section 94*a* may include at least one orthogonal segment 114*a*. The orthogonal segment 114*a* extends in a direction that is substantially perpendicular to the mating axis 20 and substantially parallel to the orientation axis 24. Although not shown, the differential contact 44*a* may also include an orthogonal segment that is similar to the orthogonal segment 114*a*. When the electrical component 16 engages the differential contacts 42*a* and 44*a*, the orthogonal segments 114*a* may facilitate preventing the differential contacts 42*a* and 44*a* from moving or being displaced in the mating direction.

While FIG. 5 shows the differential contacts 42*a* and 44*a*, the other mating contacts 42, such as the ground contacts 42*b* and power or low speed signal contacts 42*c* (shown in FIGS. 6-8) may be retained within the connector housing 38 in a similar fashion. However, unlike the differential contacts 42*a*, the ground contacts 42*b* are bounded on one side by a longitudinal support member 116, such as a wall, fin, panel, or the like, having an extension member 118, such as rib, fin, panel, wall, or the like, upwardly extending therefrom. The power and low speed signal contacts 42*c* are bounded on both sides by longitudinal support members 116 having extension members 118 upwardly extending therefrom. As shown in FIG. 5, however, each differential contact 42*a* is bounded on either side by a truncated support member 116 that leaves the mating tips 110*a* and 112*a* exposed to air, as opposed to being bounded by plastic extension members. That is, the mating tips 110*a* and 112*a* are not bound by any portion of the truncated support member 116. Instead, the mating tips 110*a* and 112*a* extend past a level or height of the support members 116.

Figure 6:
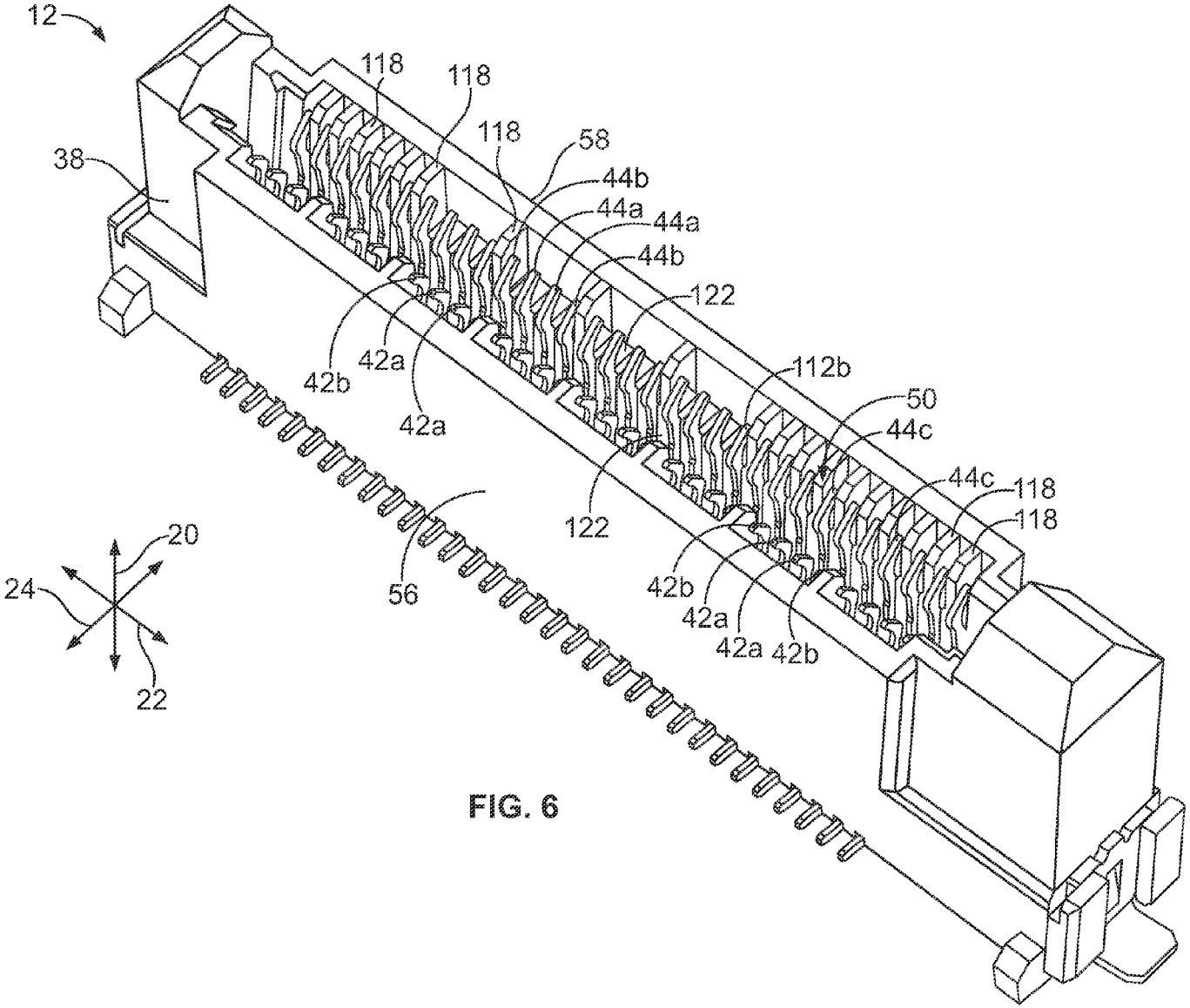
FIG. 6 illustrates a top perspective view of a receptacle connector, according to an embodiment.

FIG. 6 illustrates a top perspective view of the receptacle connector 12, according to an embodiment. FIG. 7 illustrates an enlarged top perspective view of contacts 42 and 44 within the connector housing 38 of the receptacle connector 12, according to an embodiment. Referring to FIGS. 6 and 7, the contacts 42 and 44 may include differential pair contacts 42*a* and 44*a*, ground contacts 42*b* or 44*b*, and power or low speed signal contacts 44*c*. Two neighboring differential pair contacts 42*a* or 44*a* form a differential pair. Each differential pair of contacts 42*a* or 44*a* are bounded by ground contacts 42*b* or 44*b*. For example, a differential pair of contacts 42*a* has a ground contact 42*b* on one side along the longitudinal axis 22, and another ground contact 42*b* on an opposite side along the longitudinal axis 22. Similarly, a differential pair of contacts 44*a* has a ground contact 44*b* on one side along the longitudinal axis 22, and another ground contact 44*b* on an opposite side along the longitudinal axis 22.

A differential pair of contacts 42*a* or 44*a* is a pair of conductors used for differential signaling. In general, differential pairs minimize crosstalk and electromagnetic interference. Additionally, differential pairs are well-suited for high speed data transmission.

Figure 7A:
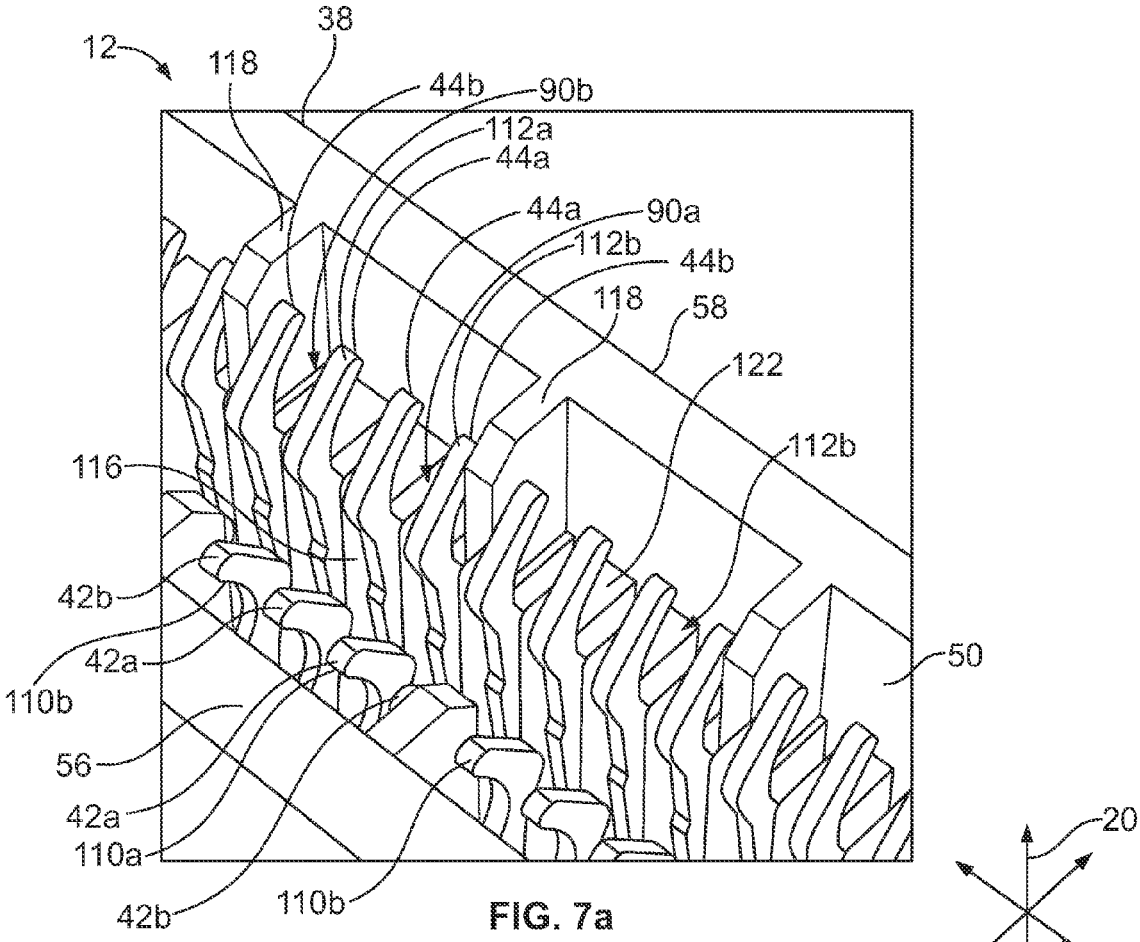
FIG. 7*a* illustrates an enlarged top perspective view of contacts within a connector housing of a receptacle connector, according to an embodiment.

As shown in FIG. 7*a*, in particular, each differential pair contact 44*a* is retained within a differential contact channel 90*a*, while each ground contact 44*b* is retained within a ground contact channel 90*b*. As shown in FIGS. 5 and 7, each differential contact channel 90*a* is defined by parallel, longitudinal support members 116, that straddle a portion of the moveable beam 104. Similarly, each differential pair contact 42*a* is retained within a differential contact channel 92*a*, while the ground contacts 42*b* are retained within a ground contact channel (hidden from view).

As shown in FIGS. 6 and 7*a*, an extension member 118 extends upwardly from the longitudinal support beam 116 about the power contacts 44*c*, and to a side of each ground contact 42*b* or 44*b* that is opposite a differential contact 42*a* or 44*a*. For example, the height of the longitudinal support members 116 on the sides of the contacts 44*c* is extended by the extension members 118. Each extension member 118 may be generally fin-shaped and extends to a height or level that is at least as great as the height of the mating tips 110*b* or 112*b* or the ground contacts 42*b* or 44*b*. However, no extension members 118 bound the differential contacts 42*a* and 44*a*. Instead, the support members 116 generally extend to a height or level below the mating tips 110*a* and 112*a*, as shown in FIG. 5. As such, the contact channels 90*a* and 92*a* are truncated or otherwise shorter than the contact channels that retain the ground contacts 42*b* and 44*b* and the other contacts 42*c* and 44*c*. As such, there is less dielectric material surrounding the differential contacts 42*a* and 44*a*, as compared to the ground contacts 42*b* and 44*b* or the power contacts 42*c* or 44*c*. As shown in FIGS. 5-7, the mating tips 110*a* and 112*a* of the differential contacts are bounded on either side by air, but not a dielectric material of a support wall, rib, fin, or the like.

In this manner, the impedance of the receptacle connector 12 may be controlled. Because air surrounds the mating tips 110*a* and 112*a* of the differential contacts 42*a* and 44*a*, respectively, there is less dielectric material surrounding the contacts 42*a* and 44*a*, and a greater amount of air exposed to the contacts 42*a* and 44*a*. Electrical characteristics of the contacts 42*a* and 44*a* are controlled by truncating or shortening the contacts channels 90*a* and 92*a*, respectively, in which they are retained, as compared to the contact channels for the ground contacts 42*b*, 44*b*, and power and low speed signal contacts 44*c*. Again, the power contacts 44*c* are bounded by extension members 118, while an extension member 118 is disposed on one side of each ground contact 42*b* or 44*b*, on an opposite side from a differential contact 42*a* or 42*b*. Each mating tip 110*a* or 112*a* of each differential contact 42*a* or 44*a*, respectively, is separated from a mating tip 110*a* or 112*a* of a neighboring differential contact 42*a* or 44*a* by air, which has a different dielectric constant than the plastic extension members 118, and thus affects the electrical characteristics of the differential contacts 42*a* and 44*a* differently as compared to the ground contacts 42*b* and 44*b*, for example. The mating tips 110*a* and 112*a* of the differential contacts 42*a* and 44*a* are within air pockets or air gap zones, instead of being bounded by plastic, such as plastic material of the ribs 118.

For example, air has a dielectric constant of 1, which is substantially less than the dielectric constant of plastic (approximately 3.50). A higher dielectric constant results in a lower impedance and slower signal propagation. Therefore, lowering the dielectric constant by surrounding the mating tips 110*a* and 112*a* of the differential contacts 42*a* and 44*a*, respectively, with air instead of the plastic of the extension members 118 results in a higher impedance with respect to the differential contacts 42*a* and 44*a* and faster signal propagation. The height of the support walls and extension members may be adjusted in order to tune the impedance to a desired level.

When the receptacle connector 12 is mated with the plug connector 14 (shown in FIG. 1), the plastic of the connector housing 38 and the plastic of the plug connector 14 cause impedance variations with respect to the contacts 42 and 44. By removing the extension members 118 around the differential contacts 42*a* and 44*a*, as discussed above, the receptacle connector 12 may be tuned to accommodate for such impedance variations, thereby resulting in a steady and constant impedance throughout the receptacle connector 12 and the plug connector 14. In this manner, impedance variations are minimized. When variations of impedance within the system 10 (FIG. 1) are minimized (that is, impedance and capacitance become more constant and flat-lined, as opposed to varying from a flat-line constant), more energy is able to travel through the system 10, as opposed to being reflected back to energy sources due to impedance variations. Thus, the system 10 is able to more efficiently transmit energy.

Figure 7B:
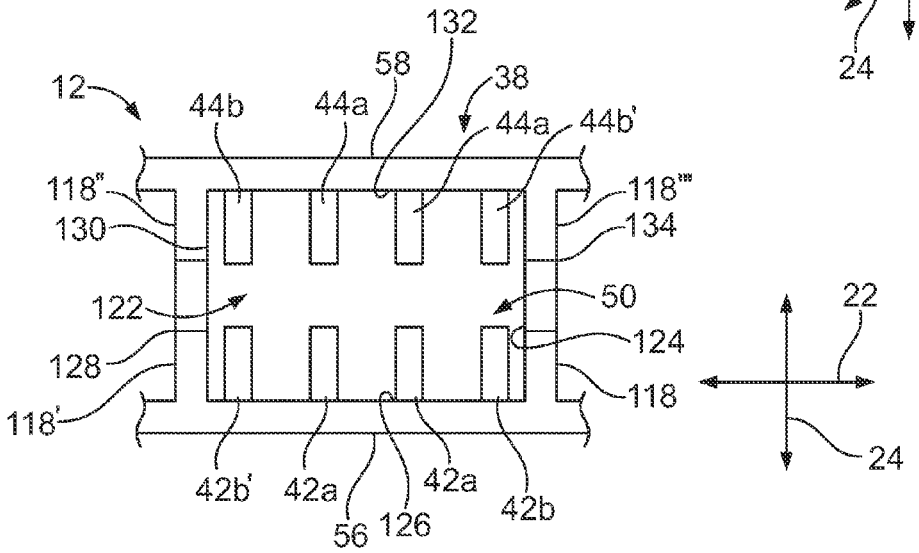
FIG. 7*b* illustrates a simplified plan view of an air pocket within a connector housing of a receptacle connector, according to an embodiment.

FIG. 7*b* illustrates a simplified plan view of an air pocket or air gap zone 122 within the connector housing 38 of the receptacle connector 12, according to an embodiment. As shown in FIG. 7*b*, the differential contacts 42*a* and 44*a* are disposed within air pockets 122. Each air pocket or air gap zone 122 includes a contact set including a differential pair of contacts 42*a* or 44*a* flanked by ground contacts 42*b* or 44*b*, respectively, on either side. Each air pocket 122 forms a square or rectangular cross-sectional volume of space. For example, moving along the longitudinal axis 22 from right to left in FIG. 7*b*, the air pocket starts at an interior surface 124 of a first extension member 118 extending from the side 56 across a first ground contact 42*b*, a differential pair defined by two differential contacts 42*a*, a second ground contact 42*b*' on the opposite side of the differential pair from the first ground contact 42*b*, and then to an interior surface 128 of a second extension member 118' opposite the first extension member 118 on the side 56. Then, moving along the orientation axis 24 from bottom to top, the air pocket 122 spans across the contact cavity 50 along the interior surface 128 of the second extension member 118' to an interior side 130 of a third extension member 118" on the side 58. Then, moving along the longitudinal axis 22 from left to right in FIG. 7*b*, the air pocket 122 spans from an interior surface 132 of the side 58 from the interior side 130 of the third extension member 118" along a first ground contact 44*b*, a differential pair defined by two differential contacts 44*a*, a second ground contact 44*b*' on the opposite side of the differential pair from the first ground contact 44*b*, and then to a fourth extension member 118''' opposite the third extension member 118 on the side 58. Then, moving along the orientation axis 24 from top to bottom in FIG. 7*b*, an envelope is enclosed from the interior side 134 of the fourth extension member 118''' to the interior side 124 of the first extension member 118 until reaching the interior surface 126 of the side 56.

As shown in FIGS. 6 and 7*a*, the connector housing 38 includes the row of contacts 44, including differential contacts 44*a*, ground contacts 44*b*, and power and low speed signaling contacts 44*c*, and the row of opposed contacts 42, including differential contacts 42*a* and ground contacts 42*b*. While the power and low speed signaling contacts 44*c* are shown in the row of contacts 44, the power and low speed signaling contacts may be within the row of contacts 42.

Additionally, other contacts may be in both rows. The power and low speed signaling contacts 44*c* may be bounded by extension members 118, because impedance tuning with respect to these contacts is unnecessary, as the power and low speed signaling contacts, for example, are not susceptible to varying impedances.

Additionally, FIGS. 6 and 7*a* illustrate an extension member 118 disposed on one side of each ground contact 42*b* and 44*b*, opposite from a respective differential contact 42*a* and 44*a*, respectively. The extension members 118 proximate the ground contacts 42*b* and 44*b* may be used for mating alignment and guidance with respect to the plug connector 14. That is, the extension members 118 may align with reciprocal grooves formed in the plug connector 14 and assist in properly aligning and mating the plug connector 14 with the receptacle connector 12. Optionally, the extension members 118 proximate the ground contacts 42*b* and 44*b* may be removed. Also, alternatively, all of the extension members 118 within the connector housing 38 may be removed. Various other extension member patterns may be used with respect to the rows of contacts 42 and 44. However, the mating tips 110*a* and 112*a* of the differential contacts 42*a* and 44*a*, respectively, are contained within air pockets. That is, the mating tips 110*a* and 112*a* of the differential contacts 42*a* and 44*a* are not bounded by extension members.

Additionally, while the receptacle connector 12 is shown having the mating tips 110*a* and 112*a* of differential contacts 42*a* and 44*a* within air pockets, the plug connector 14 may be configured in a similar manner. For example, mating tips of differential contacts that form differential pairs within the plug connector 14 may also be surrounded by air, instead of plastic ribs.

Figure 8:
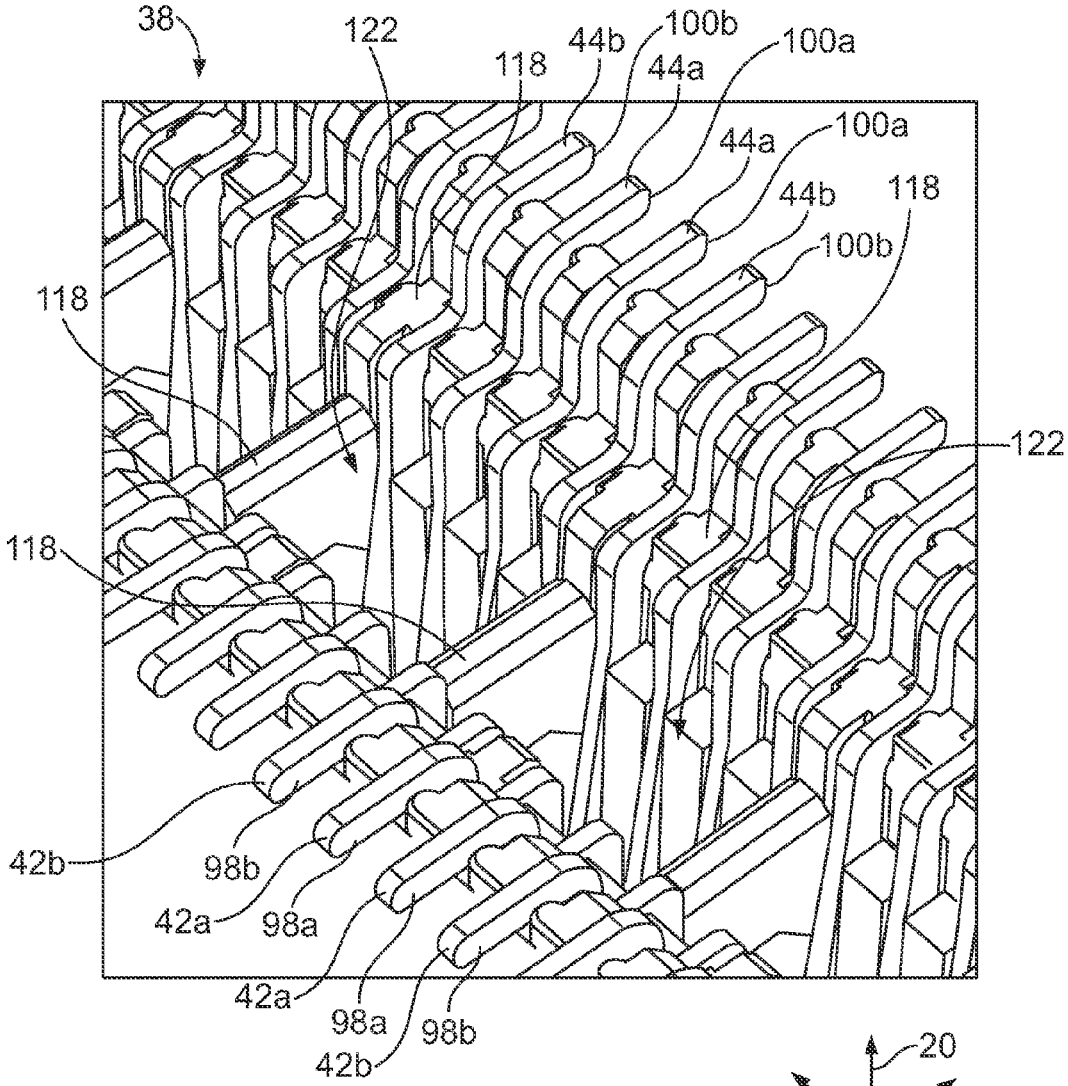
FIG. 8 illustrates an enlarged bottom perspective view of contacts within a connector housing of a receptacle connector, according to an embodiment.
Figure 8:
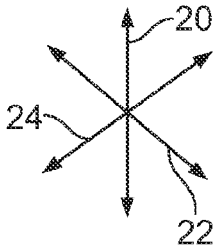

FIG. 8 illustrates an enlarged bottom perspective view of contacts 42 and 44 within the connector housing 38 of the receptacle connector 38, according to an embodiment. As shown, the tails 98*a* and 100*a* of the differential contacts 42*a* and 44*a*, respectively, are separated from the extension members 118. However, the tails 98*b* and 100*b* of the ground contacts 42*b* and 44*b*, respectively, are disposed next to an extension member 118 on a side that is opposite from a respective differential contact 42*a* or 42*b*. As shown in FIG. 8, the differential contacts 42*a* and 44*a* are disposed within the air pockets 122, as discussed above.

Figure 9:
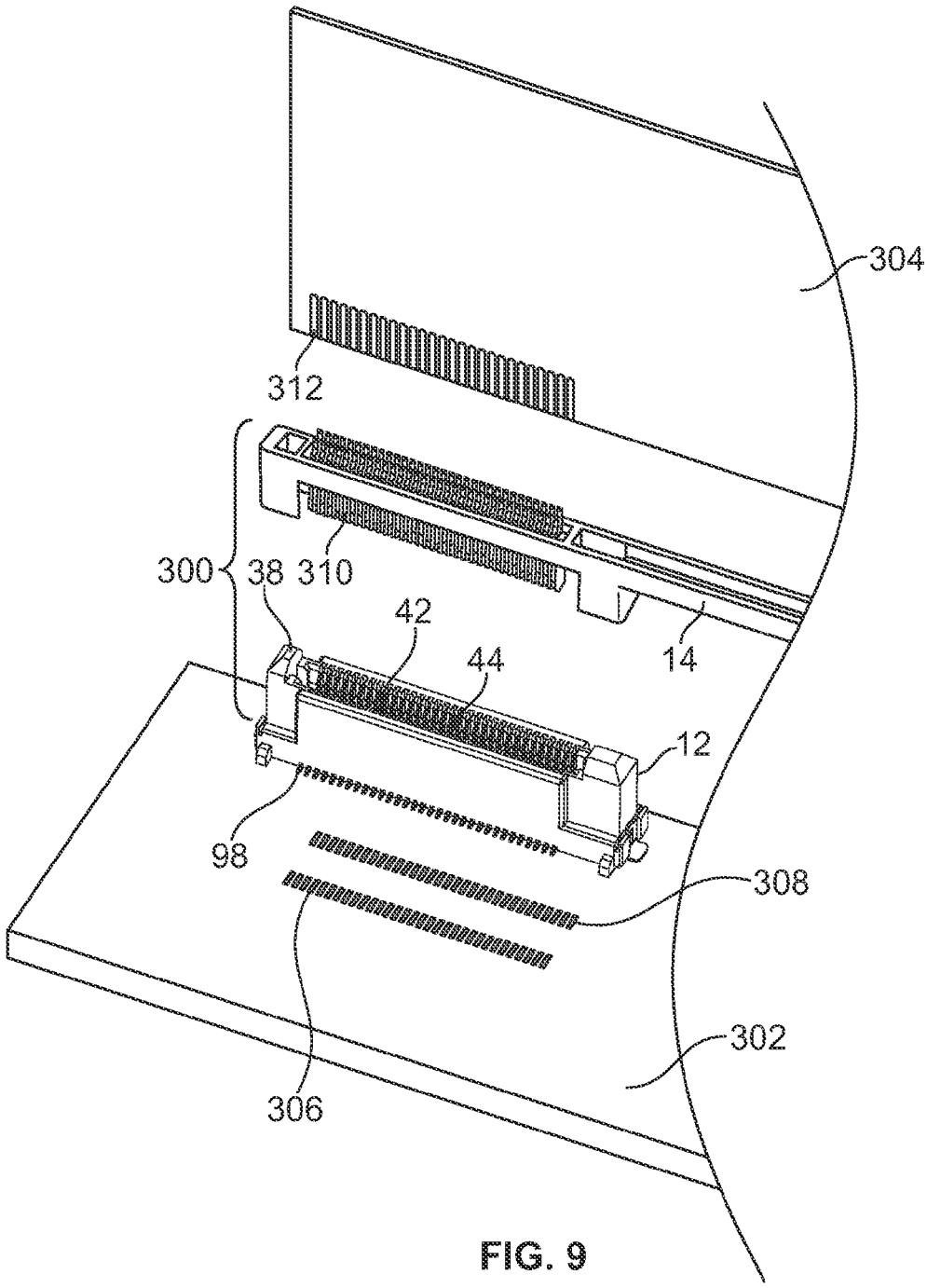
FIG. 9 illustrates an isometric exploded view of a connector assembly configured to connect a printed circuit board to a component card, according to an embodiment.
Figure 10:
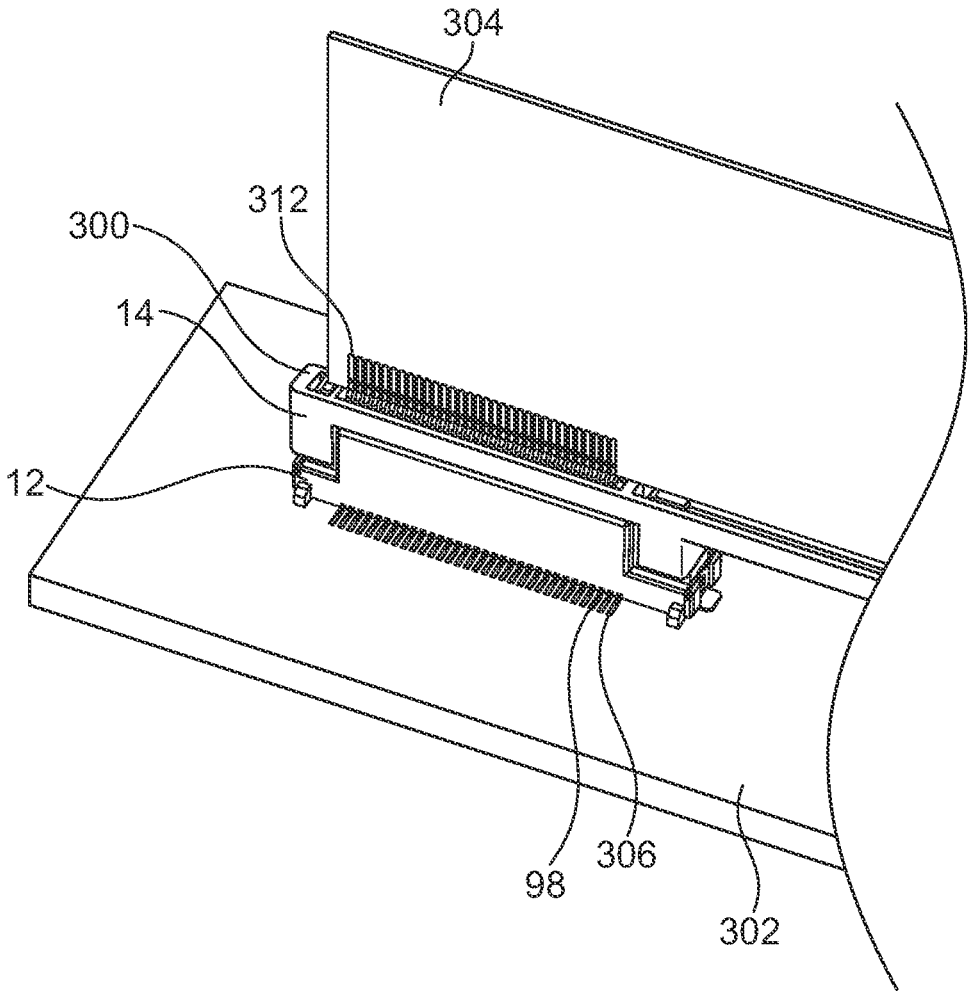
FIG. 10 illustrates an isometric view of a connector assembly connecting a printed circuit board to a component card, according to an embodiment.

FIG. 9 illustrates an isometric exploded view of a connector assembly 300 configured to connect a printed circuit board 302 to a component card 304, according to an embodiment. FIG. 10 illustrates an isometric view of the connector assembly 300 connecting the printed circuit board 302 to the component card 304. Referring to FIGS. 9 and 10, the connector assembly 300 includes the receptacle connector 12 and the plug connector 14. One or both of the receptacle connector 12 or the plug connector 14 may include differential contacts and ground contacts as described above. Further, one or both of the receptacle connector 12 or the plug connector 14 may include differential contacts within air pockets. Contact tails 98 of the contacts 42 and contact tails (not shown) of the contacts 44 are configured to electrically connect to contact plates 306 and 308, respectively, such as through soldering. The plug receptacle 14 mates with the receptacle connector 12 such that contacts 310 within the plug receptacle electrically connect with the contacts 42 and 44. The component card 304 also includes contact plates 312 that are engaged by the contacts 310 within the plug connector 14. In this manner, the connector assembly 300 electrically connects the printed circuit board 302 to the component card 304.

Figure 11:
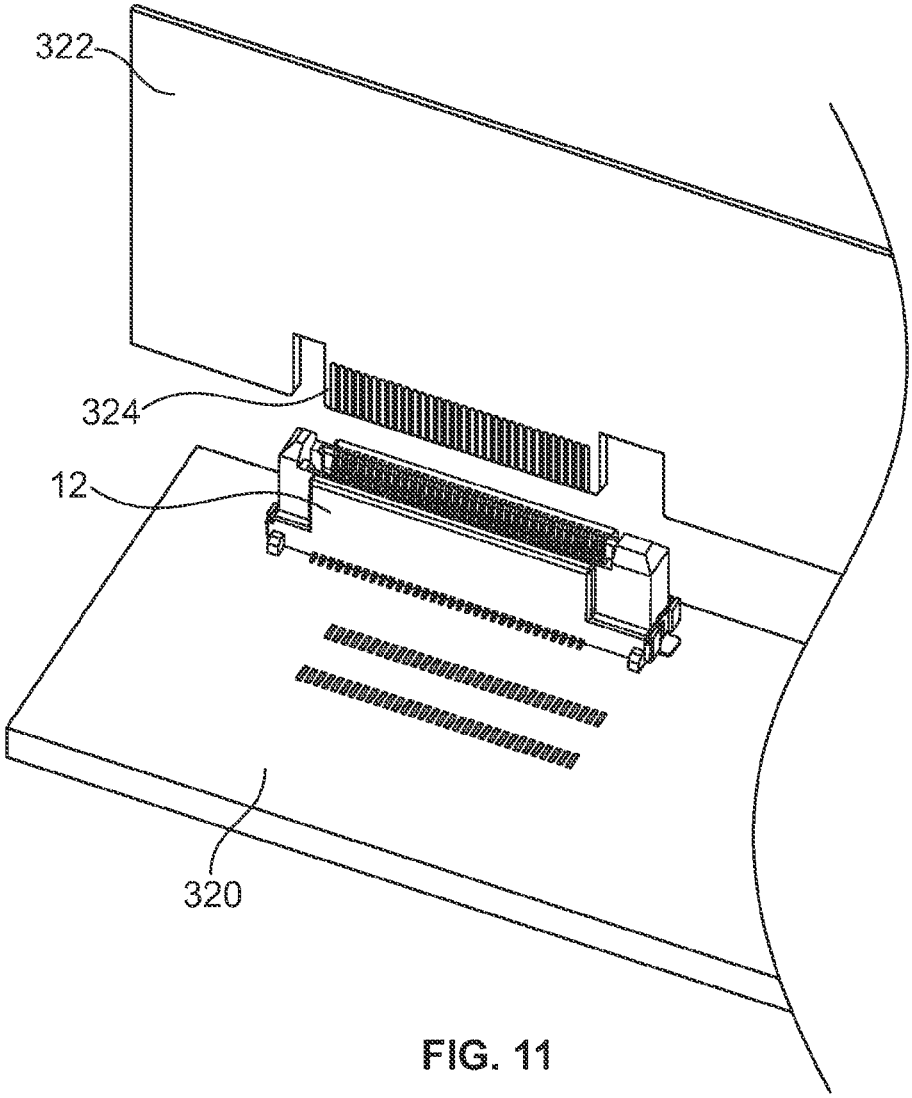
FIG. 11 illustrates an isometric exploded view of a receptacle connector configured to connect a printed circuit board to a card having a plug portion, according to an embodiment.
Figure 12:
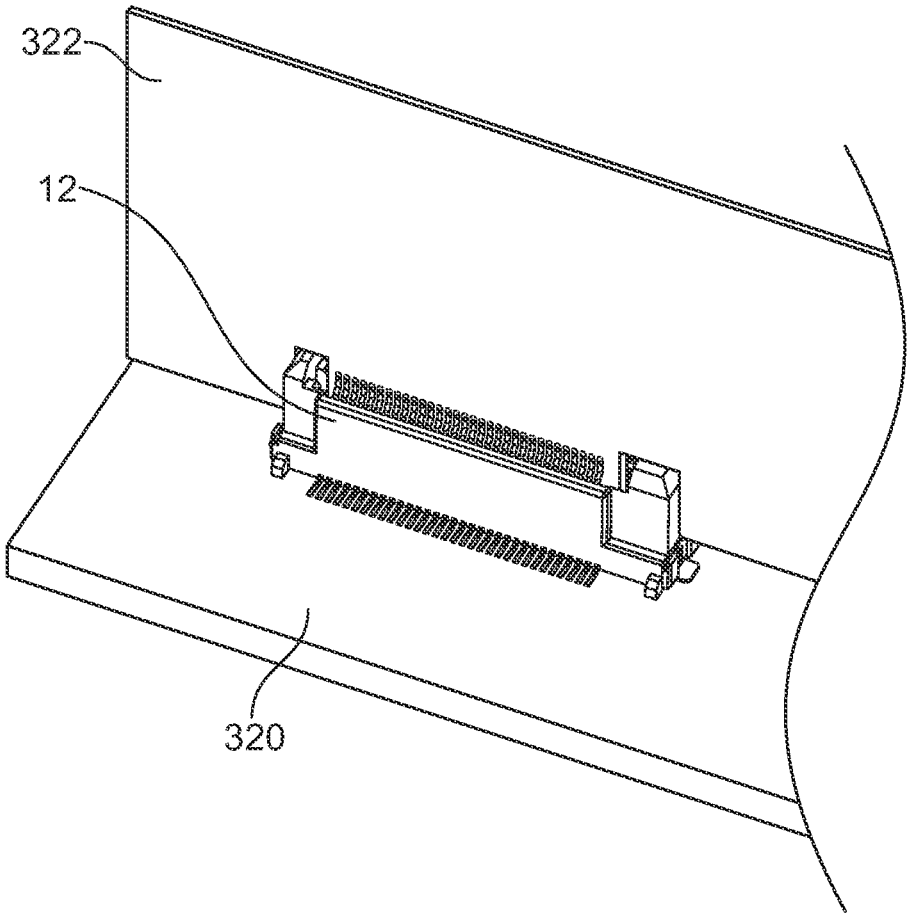
FIG. 12 illustrates an isometric view of a receptacle connector connecting a printed circuit board to a card having a plug portion, according to an embodiment.

FIG. 11 illustrates an isometric exploded view of the receptacle connector 12 configured to connect a printed circuit board 320 to a card 322 having a plug portion 324, according to an embodiment. FIG. 12 illustrates an isometric view of the receptacle connector 12 connecting the printed circuit board 320 to the card 322 having the plug portion 324. The system shown in FIGS. 11 and 12 is similar to that shown in FIGS. 9 and 10, except that instead of using a plug connector, the card 322 includes the plug portion 324 that directly mates into the receptacle connector 12. As shown, the card 322 straddle mounts the receptacle connector 12.

In general, the connector assembly including either the receptacle connector 12 or the plug connector 14 described above, may be used with respect to various configurations. The connector assembly may be configured for vertical, right angle, card edge, and/or straddle mounting.

Thus, embodiments provide an electrical connector that includes differential pairs within air pockets. Accordingly, embodiments may be used with a system that yields a constant or otherwise less-variable impedance. Embodiments may be configured to tune differential impedance within a system. Accordingly, embodiments maximize a data rate potential of the electrical contacts.

It is to be understood that the above description is intended to be illustrative, and not restrictive. In addition, the above-described embodiments (and/or aspects or features thereof) may be used in combination with each other. Furthermore, many modifications may be made to adapt a particular situation or material to the teachings of the invention without departing from its scope.

While various spatial and directional terms, such as top, bottom, lower, mid, lateral, horizontal, vertical, front and the like may be used to describe embodiments, it is understood that such terms are merely used with respect to the orientations shown in the drawings. The orientations may be inverted, rotated, or otherwise changed, such that an upper portion is a lower portion, and vice versa, horizontal becomes vertical, and the like.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector configured to electrically connect a first electrical component to a second electrical component, the electrical connector comprising:

a connector housing having opposed sides connected to opposed endwalls, wherein a contact cavity is defined between the opposed sides and the opposed endwalls, wherein a plurality of first support members and a plurality of second support members extend from the opposed sides into the contact cavity, and wherein each of the plurality of first support members is shorter than each of the plurality of second support members; and first and second differential contacts that define a differential pair retained within the contact cavity, wherein the first and second differential contacts are retained within the contact cavity between two of the plurality of first support members, wherein at least a portion of each of the first and second differential contacts extends past a level of the plurality of first support members, and wherein the at least a portion of each of the first and second differential contacts is exposed to air.

2. The electrical connector of claim 1, further comprising:

a first ground contact adjacent to a first side of the differential pair; and a second ground contact adjacent to a second side of the differential pair, wherein the second side is opposite the first side, wherein each of the first and second ground contacts is retained within the contact cavity between one of the plurality of second support members and one of the plurality of first support members, and wherein each of the plurality of second support members is at least as long as the first and second ground contacts.

3. The electrical connector of claim 1, further comprising a plurality of power and/or low speed signaling contacts retained within the contact cavity between two of the plurality of second support members, and wherein the second support members are at least as long as the plurality of power and/or low speed signaling contacts.

4. The electrical connector of claim 1, wherein the at least a portion of the first and second differential contacts are not bound by any portion of the plurality of first support members.

5. The electrical connector of claim 1, wherein each of the first and second differential contacts comprises a contact tail integrally connected to a moveable beam that is, in turn, integrally connected to a mating tip.

6. The electrical connector of claim 5, wherein the at least a portion of the first and second differential contacts comprises the mating tip.

7. The electrical connector of claim 5, wherein the at least a portion of the first and second differential contacts comprises the contact tail.

8. The electrical connector of claim 1, wherein the differential pair is retained within an air pocket of the connector housing.

9. The electrical connector of claim 1, wherein each of the plurality of first support members comprises a first support wall, and wherein each of the plurality of second support members comprises an extension rib extending from a second support wall.

10. The electrical connector of claim 1, wherein the connector housing comprises a component-receiving region configured to receive a plug connector.

11. The electrical connector of claim 1, wherein the connector housing comprises a plug portion configured to be received and retained by a receptacle connector.

12. An electrical connector configured to electrically connect a first electrical component to a second electrical component, the electrical connector comprising:

a connector housing having opposed sides connected to opposed endwalls, wherein a contact cavity is defined between the opposed sides and the opposed endwalls, wherein first support members and second support members extend from the opposed sides into the contact cavity, wherein each of the first support members comprises a first support wall, wherein each of the second support members comprises an extension member extending from a second support wall, and wherein each of the second support members is longer than each of the first support members;

first differential contacts and second differential contacts that define differential pairs retained within the contact cavity, wherein each of the first and second differential contacts is retained within the contact cavity between two of the first support members, wherein at least a portion of each of the first and second differential contacts is exposed to air by extending past a level of the first support members;

first ground contacts and second ground contacts, wherein each of the differential pairs is positioned within the contact cavity between one of the first ground contacts and one of the second ground contacts, wherein each of the first and second ground contacts is retained within the contact cavity between one of the second support members and one of the first support members, and wherein each of the second support members is at least as long as each of the first ground contacts and the second ground contacts; and power and/or low speed signaling contacts, wherein each of the power and/or low speed signaling contacts is retained within the contact cavity between two of the second support members, and wherein each of the second support members is at least as long as each of the power contacts and/or low speed signaling contacts.

13. The electrical connector of claim 12, wherein the at least a portion of the first and second differential contacts are not bound by any portion of the plurality of first support members.

14. The electrical connector of claim 12, wherein each of the first and second differential contacts comprises a contact tail integrally connected to a moveable beam that is, in turn, integrally connected to a mating tip.

15. The electrical connector of claim 14, wherein the at least a portion of the first and second differential contacts comprises the mating tip.

16. The electrical connector of claim 14, wherein the at least a portion of the first and second differential contacts comprises the contact tail.

17. The electrical connector of claim 12, wherein each of the differential pairs is retained within an air pocket of the connector housing.

18. The electrical connector of claim 12, wherein the connector housing comprises a component-receiving region configured to receive a plug connector.

19. The electrical connector of claim 12, wherein the connector housing comprises a plug portion configured to be received and retained by a receptacle connector.

* * * * *